US005339965A

United States Patent [19]

Klukis et al.

[11] Patent Number: 5,339,965

[45] Date of Patent: Aug. 23, 1994

[54] GRANULAR ARTICLE SORTER HAVING IMPROVED FLUID NOZZLE SEPARATING SYSTEM

[75] Inventors: Edward L. Klukis, Salem; Avi P. Cohn, Lake Oswego, both of Oreg.

[73] Assignee: Allen Fruit Co., Inc., Newberg, Oreg.

[21] Appl. No.: 103,435

[22] Filed: Aug. 6, 1993

[51] Int. Cl.[5] ..... B07C 5/00

[52] U.S. Cl. ..... 209/639; 209/644; 209/908; 239/566; 239/562

[58] Field of Search ..... 209/639, 644, 908; 406/191, 181, 194–196; 239/566, 562

[56] References Cited

U.S. PATENT DOCUMENTS

| | | | |
|---|---|---|---|
| 2,129,681 | 9/1938 | Geibig | 239/566 |
| 3,075,641 | 1/1963 | Hutter et al. | 209/639 X |
| 3,216,567 | 11/1965 | Kelley et al. | 209/639 X |
| 3,245,530 | 4/1966 | Kelley et al. | 209/639 X |
| 3,872,306 | 3/1975 | Palmer | 250/312 |
| 4,186,836 | 2/1980 | Wassmer et al. | 209/565 |
| 4,513,868 | 4/1985 | Culling et al. | 209/581 |
| 4,520,702 | 6/1985 | Davis et al. | 83/71 |
| 4,630,736 | 12/1986 | Maughan et al. | 209/587 |
| 5,085,325 | 2/1992 | Jones et al. | 209/580 |

*Primary Examiner*—H. Grant Skaggs
*Assistant Examiner*—Carol L. Druzbick
*Attorney, Agent, or Firm*—Chernoff, Vilhauer, McClung & Stenzel

[57] ABSTRACT

A sorter for sorting transversely-spaced articles moving along a direction of travel employs an array of fluid nozzles aligned transversely to the direction of travel for separating some of the articles from others, according to differences in their physical characteristics, by selectively directing respective streams of fluid toward some of the articles to deflect them from the direction of travel. The nozzles are arranged in a substantially linear transverse alignment relative to the direction of travel, each nozzle being connected to a respective selectively operable fluid supply valve. The valves are arranged in a nonlinear array in a common plane extending generally in the direction of alignment of the nozzles, and are connected to the respective nozzles by flexible tubes of equal length which interface the nonlinear array of valves with the linear transverse array of nozzles. The tubes are embedded in a hardened polymeric material which also forms the nozzles.

9 Claims, 4 Drawing Sheets

GRANULAR ARTICLE SORTER HAVING IMPROVED FLUID NOZZLE SEPARATING SYSTEM

BACKGROUND OF THE INVENTION

The present invention relates to sorters for inspecting transversely-spaced articles as they move along a direction of travel, and separating some of the articles from others according to differences in their physical characteristics. In particular, the invention relates to the sorting of relatively small, granular articles by means of a transverse array of fluid nozzles which selectively direct respective streams of fluid toward selected articles to deflect them from their normal direction of travel.

Sorters for detecting differences in the physical characteristics of transversely-spaced articles, and separating some from others according to such differences as the articles move along a direction of travel, are well known. For example, such sorters are widely used in the food-processing industry for detecting defects in foodstuffs by optical inspection, as shown in U.S. Pat. Nos. 3,872,306, 4,186,836, 4,513,868, 4,520,702, 4,630,736, and 5,085,325. Sorters which sort larger articles such as potatoes or fruit often employ mechanical fingers, plungers, or suction tubes which operate in response to electrical defect signals received from the inspection apparatus to separate defective articles from acceptable ones. Where, however, the articles are smaller, such as beans, peas, coffee, rice, etc., it has been common for such sorters to employ solenoid-actuated transversely-spaced air nozzles for directing quick bursts of air at the defective articles to deflect them from their normal direction of travel and thereby achieve the desired separation of the articles.

The sorting of such smaller articles, particularly at increasingly higher rates of production, introduces difficult requirements with respect to the design of air nozzle separation systems. Small articles which are closely spaced transversely to their direction of travel require a correspondingly closely-spaced transverse array of small nozzles to achieve the required separation. Also, the quickness and accuracy with which the respective nozzles must be activated and deactivated increase as the articles become smaller and/or their speed of travel increases to meet higher production demands. These combined requirements of close transverse nozzle spacing and increasingly quicker and more accurate nozzle response have tended to exceed the capabilities of the currently-known air nozzle separation systems.

A principal reason for the foregoing problem is that the solenoid valves which conventionally are used to control the supply of air to the respective nozzles, in response to defect signals received from the inspection apparatus, are much larger than the nozzles which they control, and such valves therefore consume much more space than do the nozzles themselves. Where close transverse spacing of a large number of nozzles is required (such as 128 nozzles in a 42-inch transverse span), the problem of providing space for an equal number of solenoid valves to control the nozzles becomes a difficult one. This is partially because the solenoid valves need to be in close proximity to the nozzles to minimize the delay between solenoid actuation and emission of the airstream from the nozzle in order to provide quick response. Also, the respective conduit lengths between the solenoid valves and their respective nozzles should be substantially equal so that the air-emission delays are uniform from nozzle to nozzle for accuracy in deflecting articles. In addition, the nozzles should be as close as possible both to the article inspection point and to the path of travel of the articles themselves for purposes of accuracy. These combined requirements are difficult to satisfy in a compatible fashion because of space limitations.

For example, a previous air nozzle separation system marketed by the assignee of the present invention employed a linear transverse alignment of air nozzles on the front of a transversely-extending manifold assembly, with large individual solenoid valves being arranged in transverse rows peripherally around the top, rear and bottom of the manifold, protruding radially therefrom and forming a voluminous structure difficult to position in close proximity to the optical inspection station of the sorter. Moreover, the large mass of each solenoid valve limited the speed of valve actuation.

In an attempt to alleviate the space limitation problem, other previously-known systems have employed multiple transverse rows of solenoid valves located at different distances from the transversely-aligned nozzles with different-length sets of air conduits interstitially interconnecting the respective rows of valves to the aligned nozzles. However, the delay time between solenoid actuation and nozzle emission is both long and nonuniform from nozzle to nozzle, adversely affecting both speed and accuracy.

Alternatively, other previous systems have employed multiple transverse rows of nozzles spaced apart along the direction of travel of the articles, with the transverse spacings of the nozzles of the respective rows being staggered. However, since the respective transverse rows of nozzles are at different distances from the inspection station along the direction of travel, different electrical delay times are needed for actuation of the respective rows of nozzles which adversely affects accuracy. Also, the staggered or interstitial relationship of the nozzles of the respective rows places each transversely adjacent pair of nozzles in different rows. Thus, transversely adjacent nozzle pairs cannot cooperate with each other effectively to deflect articles which may pass transversely between them, because the pair of nozzles cannot simultaneously emit their respective airstreams.

SUMMARY OF THE INVENTION

The present invention overcomes the foregoing drawbacks of previous air nozzle separation systems.

In one aspect of the present invention, each fluid nozzle of a transversely-aligned, mutually adjacent group of nozzles is connected operatively to one of a group of fluid supply valves which are arranged in a nonlinear array in a common plane extending generally in the direction of alignment of the group of nozzles.

Preferably, the nonlinear array of valves is substantially circular and lies in a plane substantially parallel to the direction of nozzle alignment, with the valves being interconnected with the respective nozzles by means of respective flexible tubes substantially equal in length.

In another aspect of the invention, the flexible tubes extending from the nonlinear array of valves to the linearly-aligned nozzles are embedded in a hardened polymeric material forming a compact and rigid unit. Preferably the nozzles are also formed in the polymeric material.

The nonlinear array of valves in a common plane enables the use of extremely compact conventional fluidic solenoid valve groups of low mass and extremely quick response in such a way as to achieve short and substantially uniform delay times between valve actuation and nozzle emission. The use of flexible tubes embedded in the hardened polymeric material to interconnect the valves with the respective nozzles additionally enables the construction of a highly compact nozzle system having short and uniform delay times.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
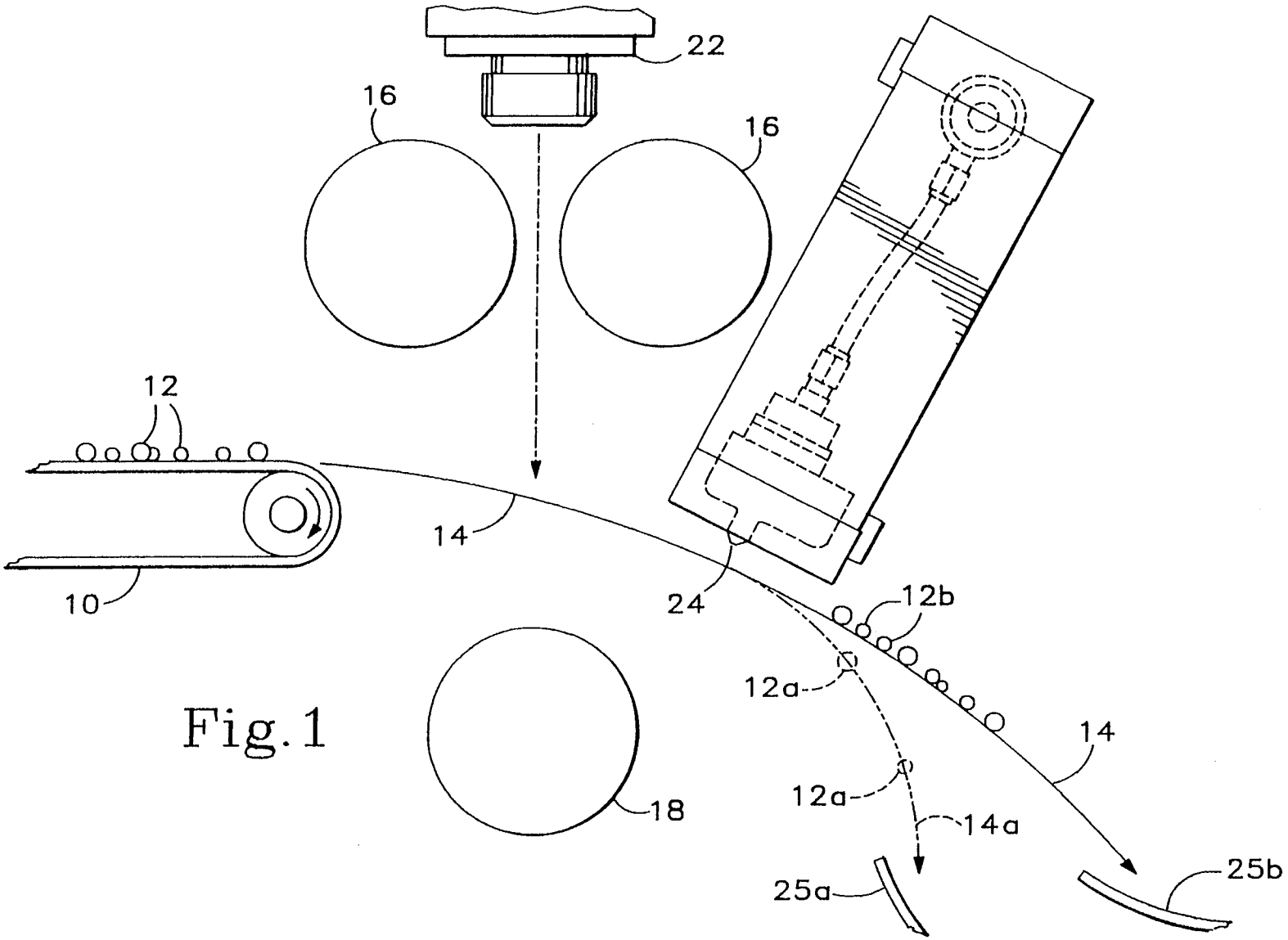
FIG. 1 is a simplified side view of a sorter showing an optical inspection station and an exemplary embodiment of the air nozzle separation system of the present invention.

A sorter including a preferred embodiment of the present invention comprises an endless belt 10 of substantial width for propelling transversely-spaced articles 12 along a direction of travel 14. As the articles 12 are propelled off the end of the belt 10 they pass through an inspection station having illumination light sources 16 and a background light source 18, and viewed by a camera 22 which optically detects defects in the articles in a conventional manner, usually in response to differences in shade, color or shape. The camera generates, through conventional circuitry (not shown), defect signals identifying the defective articles. The articles continue moving along the direction of travel to a separation station where a transversely aligned array of fluid nozzles 24 separates defective articles 12*a* from acceptable articles 12*b* by selectively directing respective streams of air toward the defective articles, in response to the aforementioned defect signals, after suitable electrical delay. The streams of air deflect the defective articles 12*a* from their normal direction of travel 14 to a different direction 14*a*. The defective articles 12*a* are then received by a collector 25*a*, separating them from the acceptable articles 12*b* which are received by a different collector 25*b*.

Figure 3:
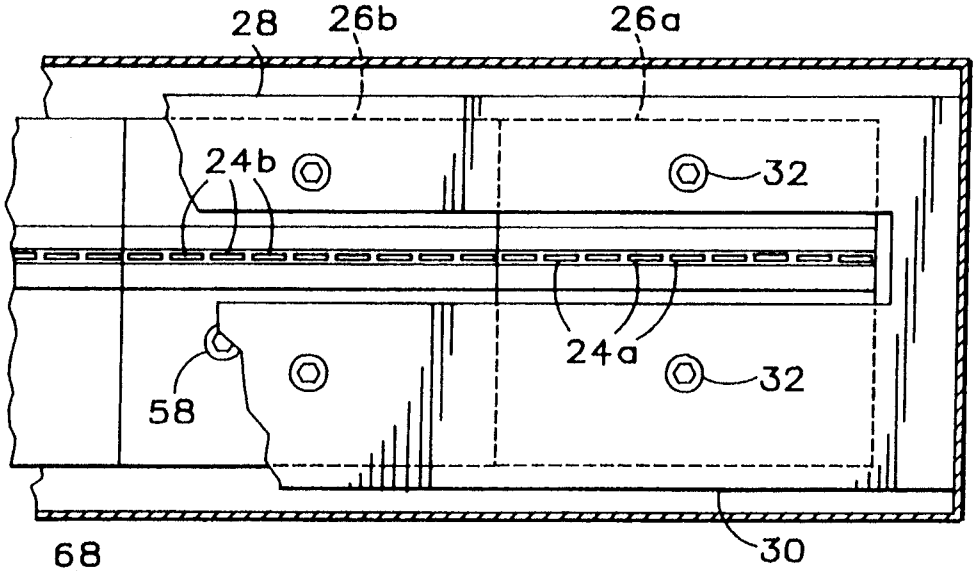
FIG. 3 is a partially sectional front view of the nozzle system taken along line 3—3 of FIG. 2.
Figure 2:
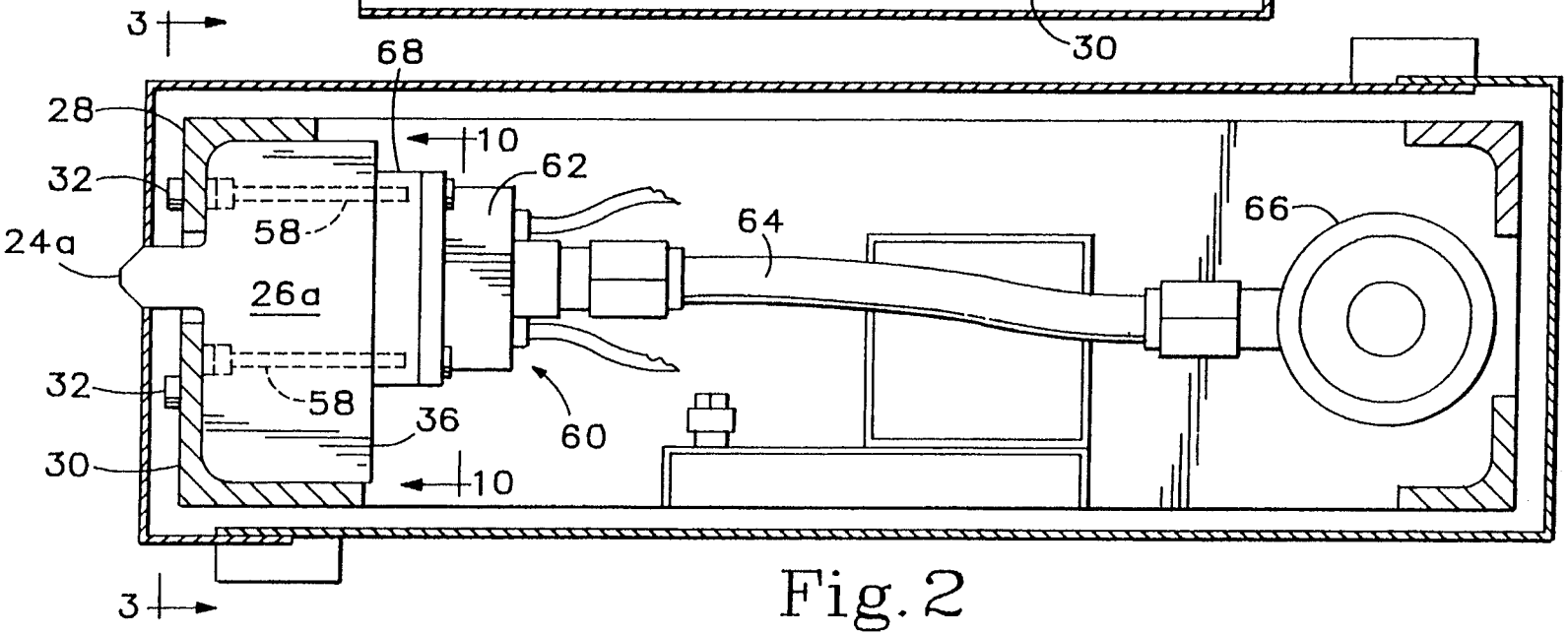
FIG. 2 is an enlarged, partially cross-sectional view of the nozzle system of FIG. 1.

With reference to FIGS. 2 and 3, the nozzles are arranged into groups of mutually adjacent nozzles such as 24*a* and 24*b*, each group being in a linear transverse alignment relative to the direction of travel 14 of the articles. The different groups of nozzles such as 24*a* and 24*b* are also in a linear transverse alignment relative to each other, as shown in FIG. 3. Each group of nozzles 24*a*, 24*b*, respectively, is formed in a respective module such as 26*a* and 26*b*, such modules being joined together in side-by-side alignment by frame members 28 and 30 to which the modules are fastened by screws 32.

Figure 5:
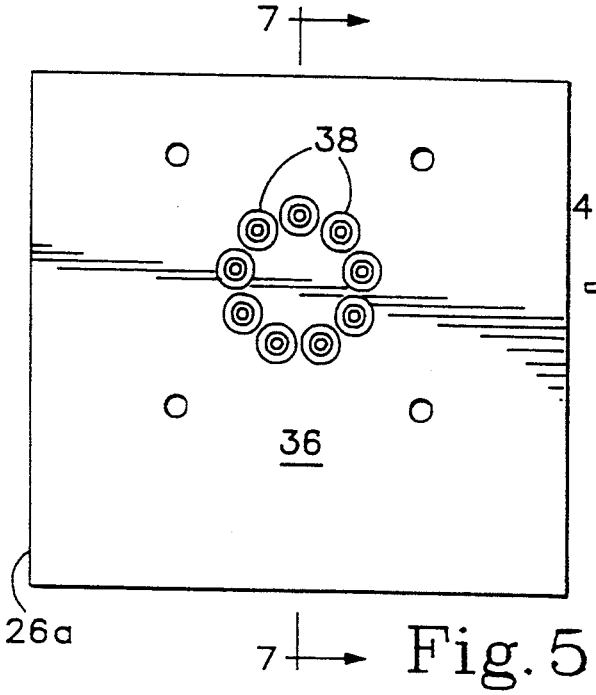
FIG. 5 is a rear view of the module of FIG. 4.

Each module, as exemplified by the module 26*a* in FIGS. 4–7, is composed of a hardened polymeric material such as polyurethane or other suitable plastic. Embedded in the hardened polymeric material of the module is a group of flexible plastic tubes 34 each connected at one end to a respective one of the transversely-aligned nozzles 24*a* which are also formed in the polymeric material. The flexible tubes 34 converge at their other ends into a circular pattern adjacent the rear planar surface 36 of the module, which is preferably parallel to the transverse direction of alignment of the nozzles 24*a*. The circular pattern is best seen in FIG. 5 where the individual ports 38 with which the tubes 34 communicate are shown.

Figure 7:
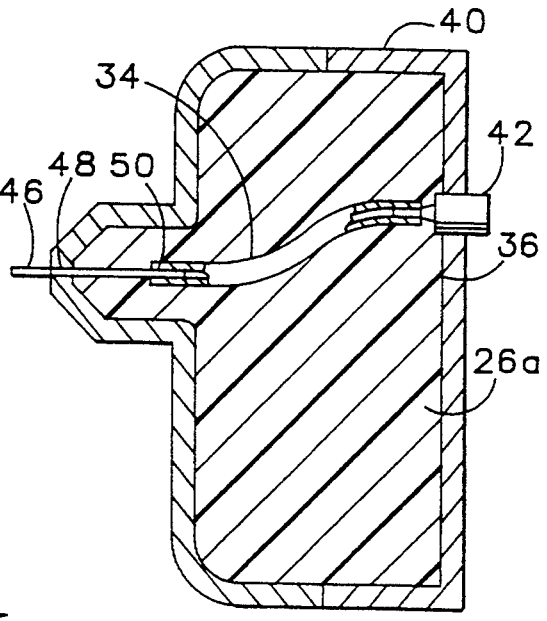
FIG. 7 is a cross section of the module taken along line 7—7 of FIG. 5 and further including a simplified schematic representation of an exemplary mold by which the module can be formed.
Figure 8:
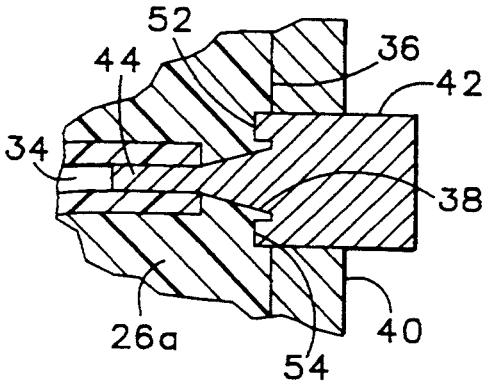
FIG. 8 is an enlarged cross-sectional detail view of a portion of the mold of FIG. 7.
Figure 4:
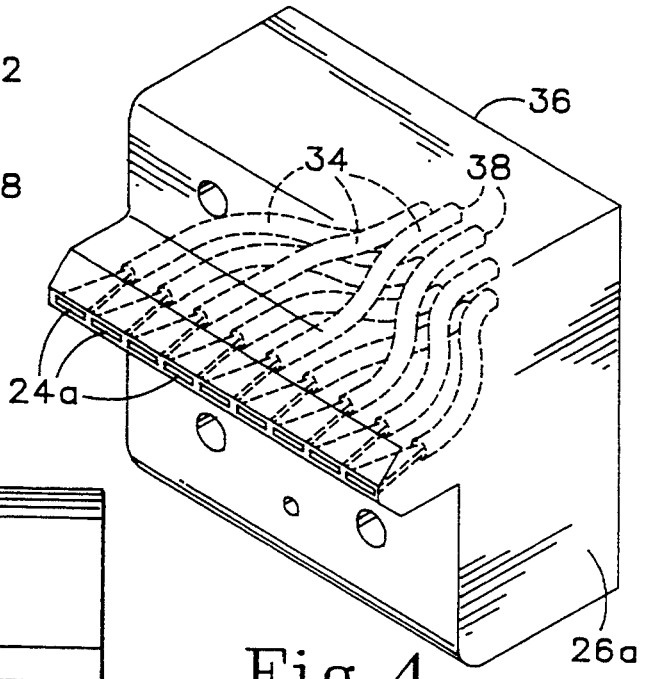
FIG. 4 is a perspective view of an exemplary nozzle module having a transversely-aligned array of nozzles.
Figure 6:
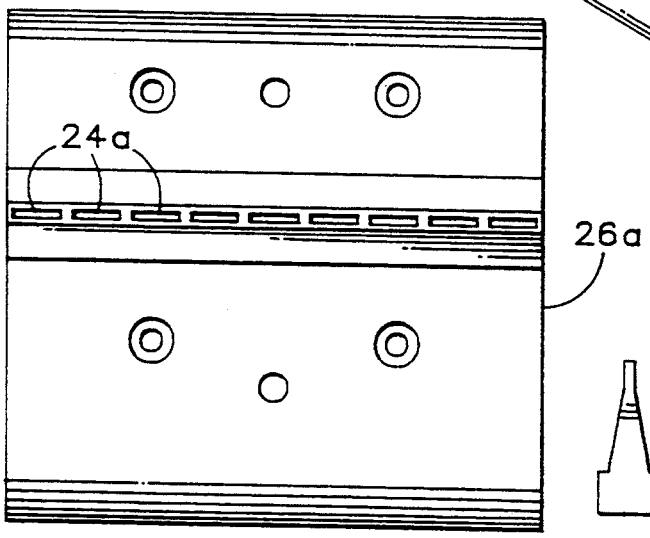
FIG. 6 is a front view of the module of FIG. 4.
Figure 9:
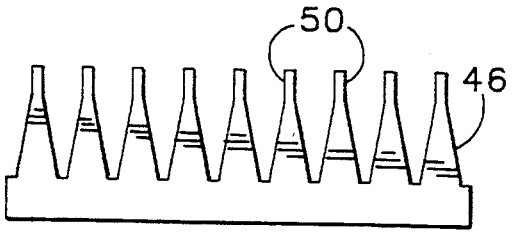
FIG. 9 is a top view of an element of the mold of FIG. 7.
Figure 11:
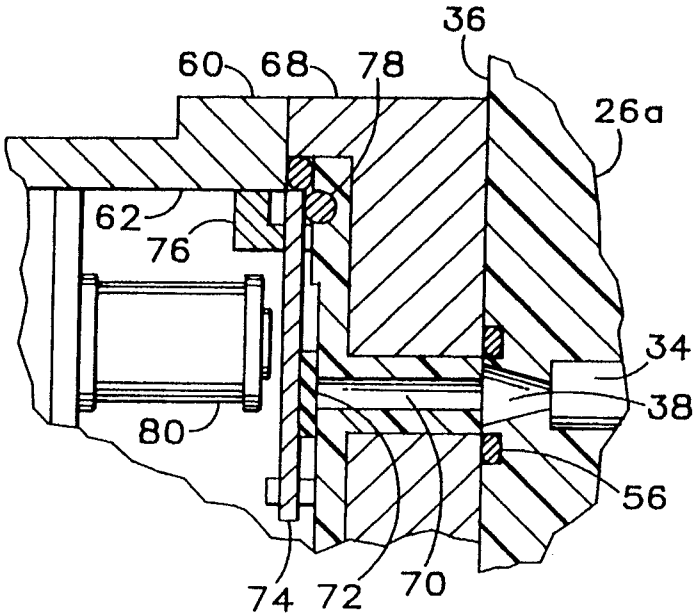
FIG. 11 is an enlarged sectional view of one of the solenoid valves taken along line 11—11 of FIG. 10.

The modules such as 26*a* are preferably formed by pouring liquid polymeric material such as polyurethane into a mold indicated schematically as 40 in FIG. 7. Prior to pouring, pin assemblies such as 42 (FIG. 8) for forming the ports 38 are inserted in the aforementioned circular pattern into the rear wall of the mold 40, and individual flexible plastic tubes 34 of equal length are fitted onto the respective posts 44 which protrude from the centers of the pin assemblies 42. As seen in FIG. 8, the pin assemblies 42 which form the ports 38 include a peripheral shoulder 52, which forms a corresponding peripheral recess 54 surrounding each port 38. The recess 54 is for the purpose of housing a sealing O-ring 56 (FIG. 11) for purposes to be described. On the opposite wall of the mold a nozzle-forming comb assembly 46 (FIGS. 7 and 9), corresponding to the number, size, shape and spacing of the nozzles desired, is fitted through a slot 48 in the mold prior to pouring, and the remaining ends of the tubes 34 are fitted onto the respective teeth 50 of the comb 46. The comb 46 is substantially flat, so that the teeth 50 somewhat deform the ends of the tubes 34 into a flattened oblong shape. After pouring and hardening of the polymeric material, the mold with its pin assemblies 42 and comb 46 is removed producing the module 26*a* with the tubes 34 embedded therein. Each module produced may be slightly different due to the fact that the flexible tubes 34, prior to pouring, assume whatever shape is natural to extend from their respective pin assemblies 42 to their respective comb teeth 50. However, the fact that the tubes are all of the same length ensures that the lengths of the respective conduits formed by the tubes, after they have been surrounded by the poured liquid polymeric material, will be of equal length so that the delay times of the airflows from the respective ports 38 to the respective nozzles 24*a* will be uniform.

Figure 10:
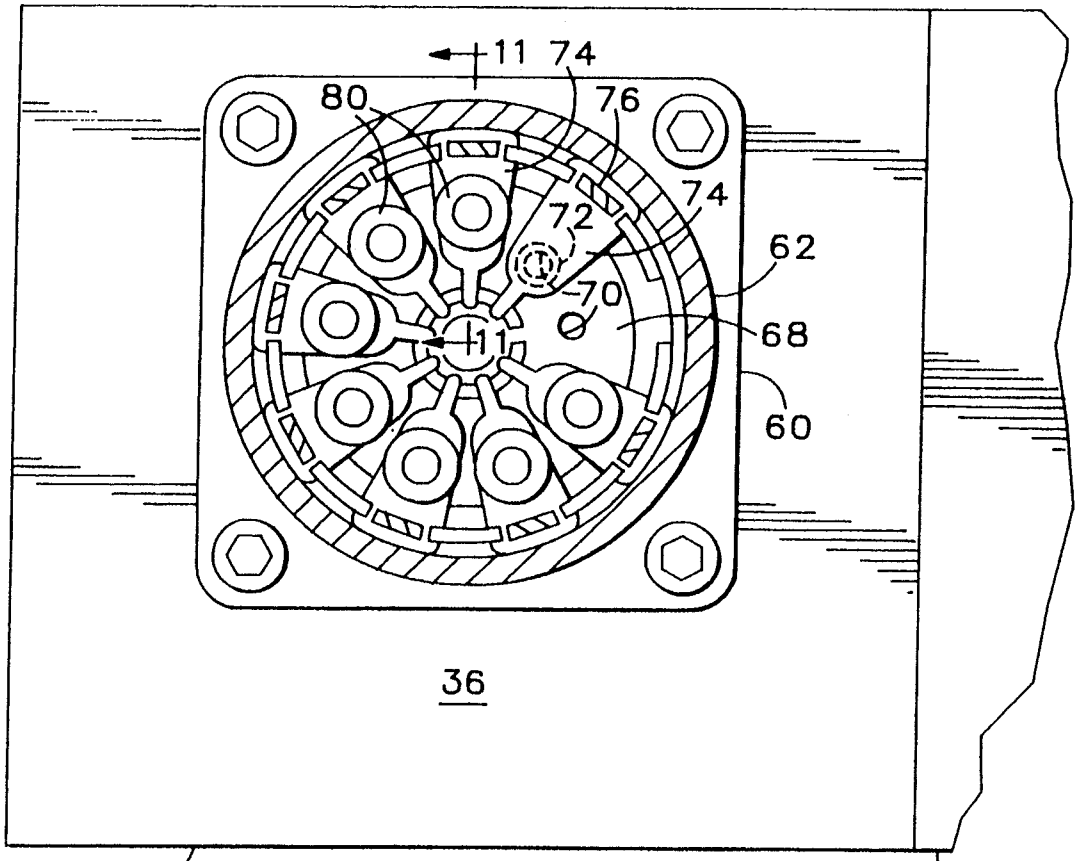
FIG. 10 is an enlarged sectional view of one of the solenoid valve arrays, taken along line 10—10 of FIG. 2.

With reference to FIG. 2, each planar rear surface 36 of a respective module such as 26*a* has attached thereto, by means of screws 58, a respective fluidic solenoid valve group assembly 60 of conventional design. Such valve groups, like their associated modules, are aligned transversely to the direction of travel 14 of the articles 12. Each valve group assembly 60 comprises an air chamber 62 supplied with compressed air through a line 64 from a manifold 66. At the end of the air chamber 62 closest to the module, a base 68 (FIGS. 10 and 11) defines a group of ports 70 extending therethrough in a circular array matching that of the ports 38 of the module. The conical shape of each port 38 compensates for any misalignment of the base 68 relative to the ports 38. With the base 68 fastened tightly to the rear surface 36 of the module by screws 58, the ports 70 thus align with the ports 38 and are sealed by the surrounding O-rings 56 mentioned earlier. Interposed between the respective ports 70 and the interior of the air chamber 62 is a group of valves 72 arranged in a circular array corresponding to that of the ports 70 and lying in a common plane parallel to the rear surface 36 of the module and thus also parallel to the linear transverse direction of alignment of the module's nozzles. Each valve 72 is mounted on a respective plate 74 of steel or other suitable magnetic material which pivots about a fulcrum 76 selectively toward or away from the respective port 70. A resilient O-ring 78 biases each plate 74 pivotally toward the respective port 70 so as to close the valve 72. The valve 72 thus remains closed unless a respective solenoid 80 is actuated to attract the plate 74 pivotally toward the solenoid, against the resilient resistance of the O-ring 78. The actuation of the solenoid 80, in response to a defect signal with appropriate electrical delay as described above, instantly causes the valve 72 to open and thereby enables compressed air within the chamber 62 to flow through the selected port 70 and-corresponding tube 34 to the selected nozzle to deflect a defective article **12*a* from the direction of travel 14. Deactivation of the solenoid 80 immediately enables the O-ring 78 to return the plate 74 and valve 72** to the closed position, thereby instantly interrupting the flow of air to the respective nozzle and preparing the nozzle for its next actuation.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A sorter for detecting differences in physical characteristics of individual articles moving along a direction of travel while spaced transversely to said direction of travel, said sorter including an array of fluid nozzles distributed transversely to said direction of travel for separating some of said articles from others of said articles according to said differences in physical characteristics by selectively directing respective streams of fluid toward said some of said articles to deflect them from said direction of travel, at least a mutually adjacent group of said nozzles being aligned substantially linearly in a transverse direction of alignment relative to said direction of travel, each nozzle of said group being connected operatively to a respective fluid supply valve of a group of valves for selectively supplying or interrupting the supply of fluid to the respective nozzles in response to said differences in physical characteristics of said articles, said group of valves being arranged in a nonlinear array in a common plate extending generally in said transverse direction of alignment of said group of nozzles, and a group of flexible tubes, each interconnecting one of said valves with one of said nozzles, wherein said flexible tubes are embedded as a group in a mass of hardened polymeric material.

2. The apparatus of claim 1 wherein said nozzles are formed in said hardened polymeric material.

3. A sorter for detecting differences in physical characteristics of individual articles moving along a direction of travel while spaced transversely to said direction of travel, said sorter including an array of fluid nozzles distributed transversely to said direction of travel for separating some of said articles from others of said articles according to said differences in physical characteristics by selectively directing respective streams of fluid toward said some of said articles to deflect them from said direction of travel, at least a group of said nozzles being aligned substantially linearly in a transverse direction of alignment relative to said direction of travel, each nozzle of said group being connected operatively to a respective fluid supply valve of a group of valves arranged in a nonlinear array for selectively supplying or interrupting the supply of fluid to the respective nozzles in response to said differences in physical characteristics of said articles, each valve of said group of valves being connected to one of said group of nozzles by a respective one of a group of flexible tubes, said tubes being embedded as a group in a mass of hardened polymeric material.

4. The apparatus of claim 3 wherein said flexible tubes are of substantially equal length.

5. The apparatus of claim 3 wherein said nozzles are formed in said hardened polymeric material.

6. The apparatus of claim 3 wherein said nonlinear array of valves is in a common plane extending in said generally transverse direction of alignment of said group of nozzles.

7. The apparatus of claim 6 wherein said nonlinear array is a substantially circular array.

8. A sorter for detecting differences in physical characteristics of individual articles moving along a direction of travel while spaced transversely to said direction of travel, said sorter including an array of fluid nozzles distributed transversely to said direction of travel for separating some of said articles from others of said articles according to said differences in physical characteristics by selectively directing respective streams of fluid toward said some of said articles to deflect them from said direction of travel, at least a mutually adjacent group of said nozzles being aligned substantially linearly in a transverse direction of alignment relative to said direction of travel, each nozzle of said group being connected operatively to a respective fluid supply valve of a group of valves arranged in a nonlinear array for selectively supplying or interrupting the supply of fluid to the respective nozzles in response to said differences in physical characteristics of said articles, each valve of said group of valves being connected to one of said group of nozzles by a respective one of a group of flexible tubes, said tubes having one set of ends connected to said linearly-aligned group of nozzles and having another set of ends terminating in a nonlinear pattern of ports located in a common plane for connection to said nonlinear array of valves, wherein said tubes are embedded as a group in a mass of hardened polymeric material.

9. The apparatus of claim 8 wherein said nozzles are formed in said hardened polymeric material.

* * * * *